US008520474B2

(12) United States Patent
Cadau et al.

(10) Patent No.: US 8,520,474 B2
(45) Date of Patent: Aug. 27, 2013

(54) PROTECTIVE CASE FOR TRANSPORTING OR STORING A PLATE-SHAPED PART PIERCED WITH AN APERTURE

(75) Inventors: Stéphane Cadau, Le Brassus (CH); Pascal Bourret, Les Rousses (FR)

(73) Assignee: Montres Breguet S.A., L'Abbaye (CH)

( * ) Notice: Subject to any disclaimer, the term of this patent is extended or adjusted under 35 U.S.C. 154(b) by 903 days.

(21) Appl. No.: 12/518,205

(22) PCT Filed: Dec. 5, 2007

(86) PCT No.: PCT/EP2007/063351

§ 371 (c)(1), (2), (4) Date: Jan. 8, 2010

(87) PCT Pub. No.: WO2008/068282

PCT Pub. Date: Jun. 12, 2008

(65) Prior Publication Data

US 2010/0108697 A1 May 6, 2010

(30) Foreign Application Priority Data

Dec. 7, 2006 (CH) ..... 1998/06

(51) Int. Cl.
*G04B 19/06* (2006.01)

(52) U.S. Cl.
USPC ..... 368/236; 368/228; 368/232; 220/632; 206/308.1; 206/310

(58) Field of Classification Search
USPC ..... 220/632, 628, 602, 4.02; 206/307, 206/309, 310, 308.1; 368/228, 232, 236
See application file for complete search history.

(56) References Cited

U.S. PATENT DOCUMENTS 646,843 A * 4/1900 Krahenbuhl ..... 368/236
1,003,132 A * 9/1911 Buckingham ..... 81/6

(Continued)

FOREIGN PATENT DOCUMENTS

CH 598 082 4/1978
DE 18 25 496 1/1961

(Continued)

OTHER PUBLICATIONS

Search Report issued in corresponding application No. PCT/EP2007/063351, completed Mar. 12, 2008 and mailed Mar. 20, 2008.

*Primary Examiner* — Anthony Stashick
*Assistant Examiner* — Christopher McKinley
(74) *Attorney, Agent, or Firm* — Griffin & Szipl, P.C.

(57) ABSTRACT

The protective case includes a back cover (2) and a cover (3), which are provided to fit together. The case further includes a flange (6), inserted in the back cover and held laterally by the edge (4), and an elastically deformable stake (7), which is for immobilizing a plate-shaped part pierced with an aperture (11). The stake is mounted on the top surface of the flange and it is inserted into the aperture of the plate-shaped part. The bottom surface of the cover (3) further carries a projecting portion (8) that presses against the stake when the case is closed, so as to increase the external diameter of the stake and jam it in the aperture of the plate-shaped part. Elastic means (9) are also provided for returning the flange (6) in the direction of the cover (3) so as to hold the stake (7) jammed in the aperture in the plate-shaped part.

10 Claims, 3 Drawing Sheets

(56) References Cited

U.S. PATENT DOCUMENTS

| | | | | | |
|---|---|---|---|---|---|
| 2,313,766 | A | * | 3/1943 | Pfanstiehl | 206/457 |
| 2,380,215 | A | * | 7/1945 | Caldara | 368/291 |
| 2,719,403 | A | * | 10/1955 | Gisiger | 368/291 |
| 3,291,134 | A | * | 12/1966 | Novales | 220/559 |
| 3,765,249 | A | * | 10/1973 | Bissell | 73/201 |
| 4,154,110 | A | * | 5/1979 | Peart et al. | 73/431 |
| 4,535,888 | A | * | 8/1985 | Nusselder | 206/311 |
| 4,874,085 | A | * | 10/1989 | Grobecker et al. | 206/308.1 |
| 5,383,553 | A | * | 1/1995 | Lammerant et al. | 206/309 |
| 5,573,120 | A | * | 11/1996 | Kaufman et al. | 206/755 |
| 5,699,324 | A | * | 12/1997 | Perrot et al. | 368/226 |
| 5,701,997 | A | * | 12/1997 | O'Brien et al. | 206/308.1 |
| 5,788,068 | A | * | 8/1998 | Fraser et al. | 206/310 |
| 5,845,771 | A | * | 12/1998 | Fu | 206/308.1 |
| 5,894,924 | A | * | 4/1999 | Koch | 206/310 |
| 5,931,294 | A | * | 8/1999 | Weingarden et al. | 206/308.1 |
| 6,047,821 | A | * | 4/2000 | Hashimoto et al. | 206/303 |
| 6,053,311 | A | * | 4/2000 | Grobecker et al. | 206/308.1 |
| 6,227,363 | B1 | * | 5/2001 | Lu | 206/308.1 |
| 6,446,797 | B1 | * | 9/2002 | Shiga | 206/303 |
| 6,799,677 | B2 | * | 10/2004 | Marsilio et al. | 206/308.1 |
| 6,951,278 | B2 | * | 10/2005 | Pettigrew et al. | 206/308.1 |
| 2003/0019771 | A1 | * | 1/2003 | Iandoli et al. | 206/310 |
| 2003/0150755 | A1 | * | 8/2003 | Chen | 206/310 |
| 2004/0206641 | A1 | * | 10/2004 | Lau | 206/308.1 |
| 2009/0152141 | A1 | * | 6/2009 | Freitag et al. | 206/308.1 |
| 2010/0302915 | A1 | * | 12/2010 | Grotell et al. | 368/285 |

FOREIGN PATENT DOCUMENTS

| | | |
|---|---|---|
| FR | 755 196 | 11/1933 |
| FR | 1 253 107 | 2/1961 |

* cited by examiner

PROTECTIVE CASE FOR TRANSPORTING OR STORING A PLATE-SHAPED PART PIERCED WITH AN APERTURE

This is a National Phase Application in the United States of International Patent Application No. PCT/EP2007/063351 filed Dec. 5, 2007, which claims priority on Swiss Patent Application No. 01998/06, filed Dec. 7, 2006. The entire disclosures of the above patent applications are hereby incorporated by reference.

The present invention concerns a protective case for transporting or storing a part in the form of a flat part, or plate, pierced with an aperture; for example a watch dial. The present invention concerns, more specifically, this type of case with a clamping device that extends into the aperture of the plate so as to retain the same. The present invention concerns, in particular, a case of this type for containing a watch dial.

It is an object of the present invention to provide a case the design of which minimises the disastrous consequences that clumsy or mistaken handling could cause. In particular, it is an object to provide a case designed such that the force with which one presses on the cover does not influence the force holding the plate-shaped part.

It is another object to provide a case for withstanding accidental shocks of 5000 g (1 meter drop onto hard wood) without the content or the case experiencing any damage whatsoever.

It is another object of the present invention to provide a case that can accommodate the broadest possible range of parts of different dimensions (diameter, thickness, aperture diameter, etc.).

It is another object of the present invention to provide a range of cases that differ from each other only in the dimensions of the clamping device, which may be adapted to the particular dimensions of one part standard.

It is another object of the present invention to provide a case into which it is easy to insert and remove a part.

It is another object of the invention to provide a case with a reduced unit cost.

The present invention achieves these objects by providing a protective case for transporting or storing a plate-shaped part pierced with an aperture, which includes a back cover and a cover, the back cover and the cover each having an edge, and said edges fitting into each other when the case is closed, the case further including a flange inserted in the back cover and held laterally by the edge thereof, and clamping means for immobilising the plate-shaped part, wherein the clamping means include an elastically deformable stake that is mounted on the top surface of the flange and is inserted in the aperture in the plate-shaped part, the clamping means further including a projecting portion formed under the bottom surface of the cover, the projecting portion being arranged to press against the stake when the case is closed so as to increase the external diameter of the stake to jam said stake in the aperture of the plate-shaped part, elastic means also being provided under the flange to return the flange and the stake in the direction of the cover with sufficient force to hold the stake jammed in the aperture of the plate-shaped part.

According to the present invention, the stake is fixedly mounted on the flange, and the flange is itself retained by elastic means provided for returning it in the direction of the cover. In these conditions, when the case is closed, the force exerted by the projecting portion onto the stake is always equal to the return force provided by the elastic means. Thus, the force with which the cover is pressed does not influence the force exerted on the stake. One advantage of the present invention is thus that the presence of elastic means avoids damaging the stake.

Another advantage of the present invention is that it prevents the stake damaging the dial under the effect of pressure that is too strong.

Another advantage of the present invention is that only the flange and the stake come into contact with the dial. The functional parts of the dial, which are located on its top surface, never have to come into contact with the different parts of the case.

Another advantage is that the elastically retained flange means that the same case can be used with dials of different thickness.

According to the present invention, the elastic means have to return the flange in the direction of the cover with enough force to hold the stake jammed in the aperture of the plate-shaped part. This means that, in order to be kept jammed in the plate aperture, the stake must offer less resistance to deformation that the elastic means. Otherwise, the diameter of the stake is insufficient to immobilise the part.

Owing to the use of an elastically deformable stake, the present invention can also provide a case that can receive plate-shaped parts, which differ as regards the diameter of their aperture.

According to an advantageous variant of the present invention, the stake includes a tubular element that is slit longitudinally, and the slit walls of the tubular element form at least two elastic arms. Moreover, when the case is closed, the projecting portion formed under the cover is introduced into the slit tubular element, like a wedge, to separate said elastic arms.

According to yet another advantageous variant of the present invention, the flange is cut away. This feature has the advantage of allowing dials that are already fitted with a dial-foot to be packaged Moreover, if the cut away flange feature is combined with that of a transparent or translucent back cover, this combination has the advantage of allowing identification of a reference or barcode that may be carried by the bottom surface of the plate or dial. Thus, it is not necessary to open the case in order to know what is inside.

According to yet another advantageous variant, the elastic means for returning the flange in the direction of the cover are helical springs.

According to yet another advantageous variant, the case bears a distinctive sign indicating the diameter of the stake that it contains.

A particular embodiment of the invention will now be described in detail by way of example with reference to the annexed drawings, in which.

Figure 1:
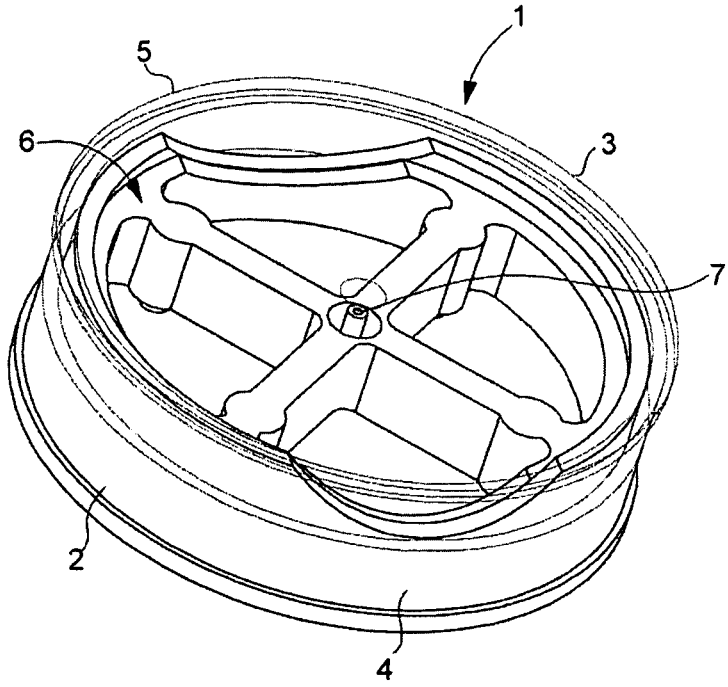
FIG. 1 is a perspective view of a protective case for transporting and storing a watch dial that corresponds to a particular embodiment of the present invention.
Figure 2:
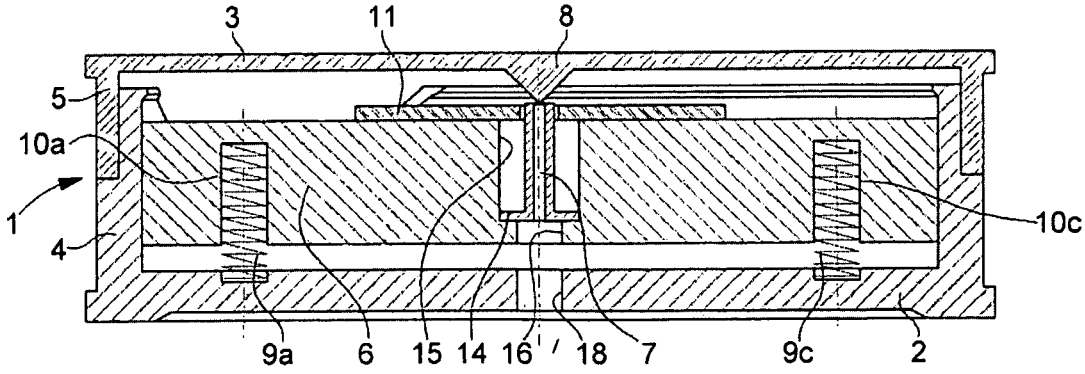
FIG. 2 is a cross-section of the protective case of FIG. 1.
Figure 3:
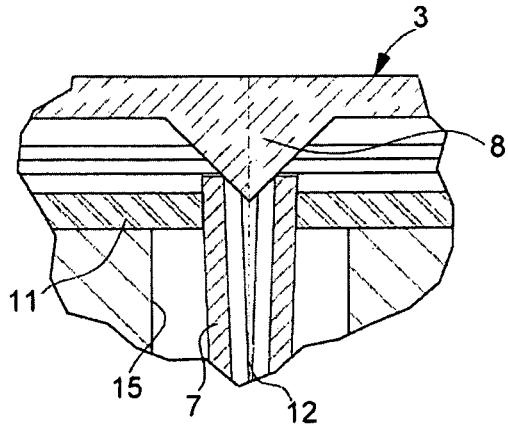
FIG. 3 is an enlarged cross-section showing the cone and arms of the stake that forms one example of clamping means according to the present invention.

Referring to FIGS. 1 and 2, it can be seen that case 1 has, first of all, an enclosed space that is defined by assembling a back cover 2 with a transparent cover 3. These two parts have cylindrical edges (respectively referenced 4 and 5), which fit together. The enclosed space houses a mobile flange 6, which can slide axially inside cylindrical edge 4. This flange 6 carries a stake 7, which is fixedly mounted to the centre of the top surface thereof. As FIG. 3 shows in more detail, stake 7 is formed by a tubular element, which is slit into four longitudinally, so as to form four arms. This tubular element is made of an elastic material, such as Teflon, for example. As will be seen in more detail below, stake 7 can cooperate with a cone-shaped projecting portion 8, formed at the centre of the bottom surface of cover 3. Finally, flange 6 is suspended on four helical springs 9*a*, 9*b*, 9*c* and 9*d*, which are compressed between flange 6 and back cover 2 (only two springs, referenced 9*a* and 9*c*) are visible in the cross-section of FIG. 2). The four springs form elastic means for returning flange 6 in the direction of cover 3.

The working of the case will now be described with reference to FIGS. 2 and 3. The case is first of all placed flat, and cover 3 is removed. A dial 11 can then be introduced into the case and positioned flat on flange 6, with the stake extending through the hole in the centre of the dial. The case can then be closed.

As soon as the lowering of the cover causes cone 8 and stake 7 (which together form the clamping device) to meet, the tip of the cone will be inserted like a wedge between the four arms of the stake. The cone will thus push the four arms radially so that they move sufficiently far apart to abut against the inner edge of the centre hole in dial 11, thus immobilising the dial.

As soon as the clamp formed by the four arms of the stake presses against the sides of the centre hole, stake 7 can no longer be deformed. It is thus mobile flange 6 that is lowered under the pressure of cover 3 compressing springs 9*a*, 9*b*, 9*c* and 9*d*, until the case is completely closed. At that moment, cylindrical edges 4 and 5 fit completely inside one another.

It will be clear that, according to the operating principle that has just been described, the elasticity of stake 7 and that of elastic means 9*a*, 9*b*, 9*c* and 9*d* which suspend flange 6, are, in a way, competing to lower cover 3 and cone 8. It is therefore important for the elastic means to be sufficiently resistant to deformation to allow the arms of stake 7 to jam the centre hole of dial 11. This means that the stake must be more flexible than the elastic means. Otherwise, the diameter of the stake cannot increase sufficiently to immobilise the dial.

According to the embodiment of the invention that forms the subject of this example, the same range of cases is provided for accommodating all of the dial models of one manufacturer. Moreover, in this example, the various cases in the range differ from each other only in the dimensions of their stake. As the stakes are interchangeable, it is clear that it is possible to package all of the dials from one manufacturer together with the same case model. As will be seen in detail below, according to this example, the stakes themselves can be identical in every way, with the exception of the (outer and inner) diameter of the clamp formed by the stake arms.

Let us assume by way of example that the centre thicknesses of the various dial models that one wishes to package using cases in accordance with the present invention are comprised between 0.25 mm and 1 mm. Let us also assume that the diameters of the dial holes are comprised between 1.1 mm and 2.7 mm. By way of example, one could choose to have four stake models with different clamp diameters. All of the stakes could have the same height of 1.1 mm so that they can receive all of the dials:

- the first stake model could have a clamp with an outer diameter of 1.05 mm. This model would suit dial hole diameters of between approximately 1.1 mm and 1.65 mm.
- the second stake model could have a clamp with a diameter of 1.45 mm. This model would suit dial hole diameters of between approximately 1.65 mm and 1.9 mm.
- the third stake model could have a stake with a diameter of 1.65 mm. This model could suit dial hole diameters of between approximately 1.7 mm and 2.3 mm.
- the fourth stake model could have a clamp with a diameter of 2.35 mm. This model would suit for dial hole diameters of between 2.4 mm and 2.7 mm.

If as in the present example, the stakes are made of Teflon, the thickness of the stake tubular element wall could be, for example, 0.3 mm for the smallest stake model. For the three larger models, the wall thickness could be for example 0.5 mm.

Moreover, cone 8 is preferably sized so as to keep a certain space between the top of the dial and the bottom of the cover, whatever the diameter of the dial centre hole. This condition is respected, for example, if the cone has an apex angle of 90° and the circular base thereof has a diameter of 3 mm.

Figure 5:
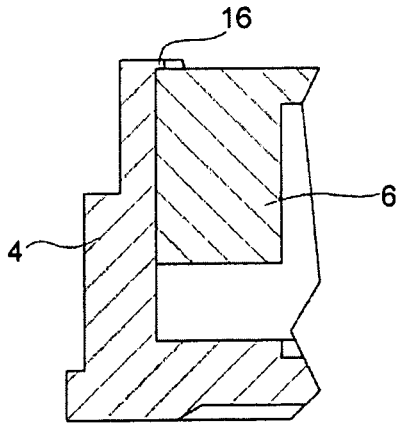
FIG. 5 is an enlarged cross-section showing the small inner shoulder of the top part of the cylindrical edge.

FIG. 5 also shows that cylindrical edge 4, inside which flange 6 moves, has a small inner shoulder 16, which is for limiting the upward travel of flange 6. The presence of shoulder 16 prevents flange 6 from disengaging from cylindrical edge 4 when the case is open. Moreover, when the case is closed, shoulder 16 guarantees that the top of dial 11 cannot come into contact with the bottom of cover 3.

Figure 4:
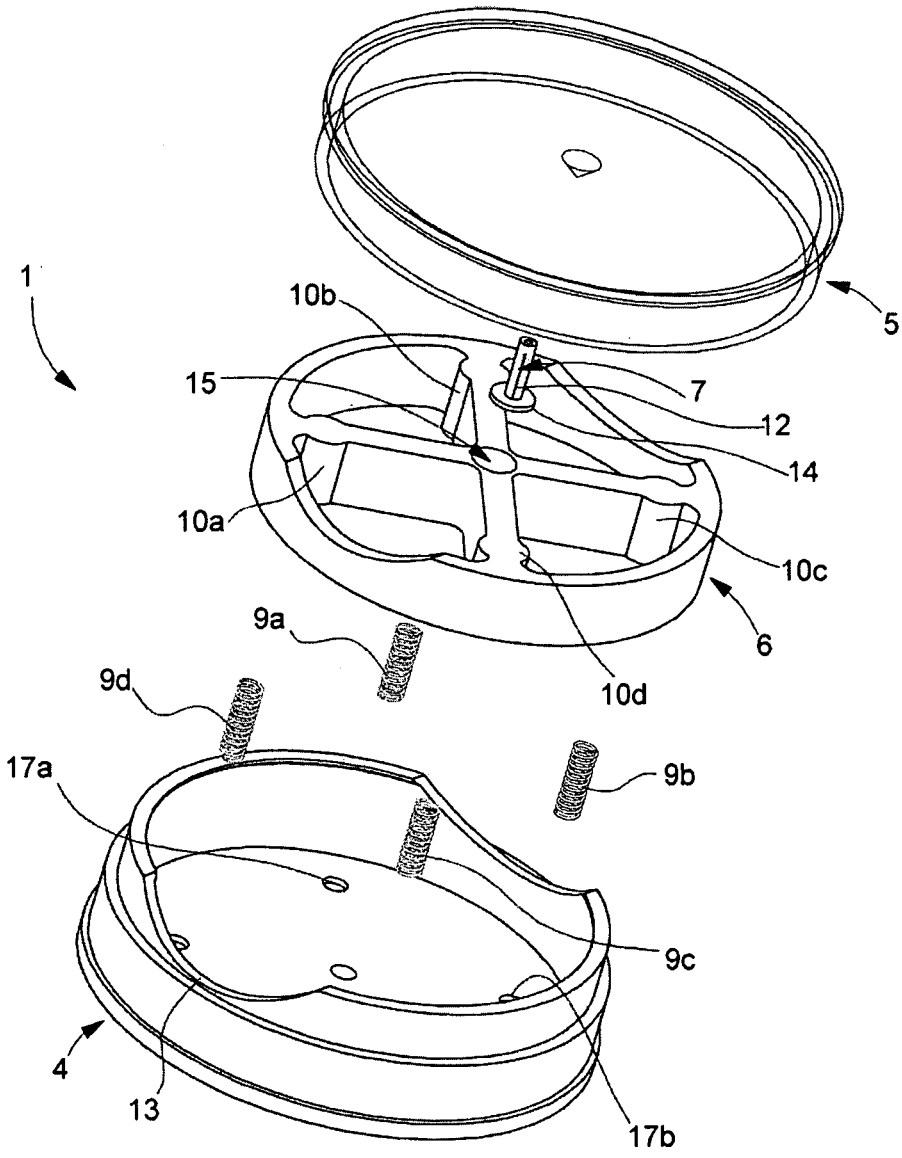
FIG. 4 is an exploded view that explains how the various components of the protective case are assembled.

Assembly of the case will now be described with reference to FIGS. 4 and 5. The first assembly operation consists in placing springs 9*a*, 9*b*, 9*c* and 9*d* in housings 17*a*, 17*b*, 17*c* and 17*d*, which are arranged for this purpose in back cover 2. The springs may, for example, simply be placed in the housing without any securing means.

The second operation consists in mounting flange 6 on the back cover. The outer diameter of the flange and the inner diameter of edge 4 are adjusted such that the flange can slide while being held laterally. However, as already stated, the top part of edge 4 has a small inner shoulder 16 for limiting the travel of flange 6 and preventing it from disengaging from cylindrical edge 4. The inner diameter of shoulder 16 is slightly less than the outer diameter of flange 6. In these conditions, during assembly, force is required to introduce the flange into back cover 2. This operation is made possible by the elasticity of the material of which edge 4 and back cover 2 are made. This material may be polystyrene for example.

Four housings 10*a*, 10*b*, 10*c* and 10*d*, each for receiving the top end of one of helical springs 9*a*, 9*b*, 9*c* and 9*d*, are also arranged in the bottom part of flange 6. During assembly, before being driven into back cover 2, flange 6 must be pre-positioned above back cover 2 with the four housings vertical to the springs. Thus FIG. 4 shows that edge 4 has two chamfers 13 for facilitating proper orientation of flange 6 relative to back cover 2. In the next step of driving the flange into the back cover, the presence of chamfers 13 also facilitates introduction of the flange. A driving in tool with a large bearing surface is preferably used for driving in flange 6 so that it descends parallel to back cover 2.

Once flange 6 is in place, the next step is to mount stake 7 on the flange. As seen above, in this example, several stake models, with tubular elements of different diameters, are required to accommodate the entire range of existing dials. In this example, all of the stake models have a base 14 with the same diameter. This feature ensures that the stakes can be interchanged.

The centre of the top surface of flange 6 has a housing formed by a cylindrical recess 15 for receiving stake 7. The inner diameter of recess 15 matches the outer diameter of base 14, so that the stake can be driven in to the bottom of the recess and held therein. The stake is preferably introduced into the recess with a tool designed to prevent damage to the stake clamp. This tool may, for example, take the form of a tube surrounding the cylindrical element of the stake and abutting against base 14.

FIG. 7 shows that cylindrical recess 15 is extended on the bottom side of the flange by a circular through hole 16. Back cover 2 of the case is also pierced with a through hole 18 arranged in the extension of the axis of recess 15. The presence of these two aligned holes means that it is possible to remove stake 7 from the case without having to remove flange 6 from back cover 2 beforehand. In fact, by inserting a pin through the back cover in holes 18 and 16, it is possible to eject stake 7 from its housing 15. This possibility is useful for example when one wishes to replace the stake in place with a stake of different diameter.

It will be clear that various alterations and/or improvements that are evident to those skilled in the art can be made to the embodiment described in the description, without departing from the scope of the present invention defined by the annexed claims.

In particular, in other embodiments, the flange and stake could be made in a single piece, so as to reduce manufacturing costs. In these conditions, one could, for example, adapt a case according to the invention to another dial dimension simply by changing the stake. In other variants the stake could also be made on the cover, not on the flange, and in such case the cone cooperating with the stake could be arranged on the flange.

In particular, the case according to the invention could be used for packaging plate-shaped parts other than watch dials. We are thinking in particular of data supports in the form of discs.

Moreover, in the example of the detailed description, the cover is transparent. This feature has the advantage of enabling the indications carried on the top surface of the dial to be read without opening the case. Moreover, in the example, the flange is cut away. This feature has the advantage of enabling dials that are already fitted with dial-feet to be packaged. Further, if the cut flange feature is combined with a transparent or translucent back cover, this combination has the advantage of allowing a reference or a barcode carried by the bottom surface of the dial to be identified.

In the example of the detailed description, the elastic means for returning the flange in the direction of the cover are helical springs. It will be clear, however, that any other form of return means known to those skilled in the art could be used in the present invention.

Finally, to facilitate management of the cases, they could be made to carry a distinctive sign indicating the diameter of the stake that they contain.

What is claimed is:

1. A protective case for transporting or storing a plate-shaped part pierced with an aperture, the protective case comprising:

(a) a back cover;

(b) a cover, wherein the back cover and the cover each have a rim and the rims fit into each other when the case is closed;

(c) a mobile flange inserted in the back cover and held laterally by the rim thereof;

(d) clamping means for immobilizing the plate-shaped part, wherein the clamping means include (i) an elastically deformable stake that is mounted on the top surface of the mobile flange and is inserted in the aperture of the plate-shaped part;

(ii) a projecting portion formed under a bottom surface of the cover, wherein the projecting portion is arranged to press against the stake when the case is closed so as to increase an external diameter of the stake to jam the stake in the aperture of the plate-shaped part; and (e) elastic means provided under the mobile flange to return the mobile flange and the stake that the mobile flange carries in the direction of the cover with sufficient force to hold the stake jammed in the aperture of the plate-shaped part.

2. The case according to claim 1, wherein the stake has a longitudinally slit tubular element, wherein a slit wall of the tubular element forms at least two elastic arms, and wherein the projecting portion formed under the cover is introduced into the slit tubular element like a wedge to separate the elastic arms so as to increase the external diameter of the stake.

3. The case according to claim 1, wherein the stake is integral with the mobile flange.

4. The case according to claim 1, wherein the stake is a part that is added to the mobile flange and wherein the diameter of the stake is determined in accordance with the diameter of the aperture of the plate-shaped part.

5. The case according to claim 1, wherein the mobile flange is cut away.

6. The case according to claim 5, wherein the back cover is transparent.

7. The case according to claim 1, wherein the cover is transparent.

8. The case according to claim 1, wherein the elastic means provided for returning the mobile flange in the direction of the cover are springs compressed between the back cover and the flange.

9. The case according to claim 1, wherein the case bears a distinctive sign indicating the diameter of the stake that it contains.

10. The case according to claim 1, wherein the plate-shaped part pierced with an aperture is a watch dial.

* * * * *